US009554674B2

(12) United States Patent
Forrest et al.

(10) Patent No.: US 9,554,674 B2
(45) Date of Patent: Jan. 31, 2017

(54) SHOWER ROD MOUNTING ASSEMBLY

(71) Applicant: LIBERTY HARDWARE MFG. CORP., Winston-Salem, NC (US)

(72) Inventors: Earl David Forrest, Asheboro, NC (US); Kelly Kovacs, Jamestown, NC (US); Rick Roetken, Avon, IN (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 567 days.

(21) Appl. No.: 14/048,553

(22) Filed: Oct. 8, 2013

(65) Prior Publication Data

US 2015/0096117 A1 Apr. 9, 2015

(51) Int. Cl.

| | |
|---|---|
| ***A47K 3/38*** | (2006.01) |
| ***A47H 1/022*** | (2006.01) |
| *A47H 1/02* | (2006.01) |

(52) U.S. Cl.

CPC ..... *A47K 3/38* (2013.01); *A47H 1/022* (2013.01); *A47H 2001/0215* (2013.01); *Y10T 29/4997* (2015.01); *Y10T 29/49863* (2015.01)

(58) Field of Classification Search

CPC .. A47K 3/38; A47H 1/022; A47H 2001/0215; A47H 1/14; A47H 1/142

USPC ..... 4/558, 610; 248/205.3, 307

See application file for complete search history.

(56) References Cited

U.S. PATENT DOCUMENTS

| | | | | |
|---|---|---|---|---|
| 264,947 | A | 9/1882 | Heyl | |
| 353,505 | A | 11/1886 | Rollins | |
| 805,570 | A | 11/1905 | Maldaner | |
| 905,142 | A | 12/1908 | Bond | |
| 1,556,733 | A | 10/1925 | Talbot | |
| 3,098,272 | A | 7/1963 | Frye | |
| 3,300,164 | A | 1/1967 | Welles | |
| 3,595,511 | A * | 7/1971 | Summerville, Jr. | A47H 1/14 160/324 |
| 4,088,174 | A * | 5/1978 | Edwards | A47K 3/38 160/349.1 |
| 4,101,104 | A | 7/1978 | Minard | |
| 4,270,720 | A | 6/1981 | Fukuchi | |
| 4,671,482 | A | 6/1987 | Shapiro | |
| 4,924,071 | A | 5/1990 | Jacobs | |
| 4,967,740 | A | 11/1990 | Riedel | |

(Continued)

FOREIGN PATENT DOCUMENTS

| | | |
|---|---|---|
| CN | 2845629 Y | 12/2006 |
| EP | 1002846 B1 | 4/2004 |

(Continued)

*Primary Examiner* — J. Casimer Jacyna

(74) *Attorney, Agent, or Firm* — Brooks Kushman P.C.; Lora Graentzdoerffer

(57) ABSTRACT

A shower rod mounting assembly is provided with a flexible substrate having a first side and a spaced apart second side. A reversible dry adhesive layer at least partially covers the first side of the substrate to attach the flexible substrate to a surface and leave the underlying surface unmarked after removal. The reversible adhesive retains an adhesion property for a plurality of adhesion cycles. A receptacle is mounted to the second side and is adapted to receive an end of a shower rod. A boss extends from the substrate with a track formed therein with an opening to receive an end of a shower rod. A biasing member extends from the substrate adjacent to the opening to retain the end of the shower rod after installation.

19 Claims, 4 Drawing Sheets

(56) References Cited

U.S. PATENT DOCUMENTS 5,149,741 A 9/1992 Alper et al.
5,275,367 A 1/1994 Frye
5,409,189 A 4/1995 Lühmann
5,507,464 A 4/1996 Hamerski et al.
5,516,581 A 5/1996 Kreckel et al.
5,672,402 A 9/1997 Kreckel et al.
5,755,913 A 5/1998 Liaw et al.
5,921,514 A 7/1999 Schumann
5,989,708 A 11/1999 Kreckel
6,001,471 A 12/1999 Bries et al.
6,106,937 A 8/2000 Hamerski
6,120,867 A 9/2000 Hamerski et al.
6,131,864 A * 10/2000 Schumann ..... A47G 1/175 248/205.3
6,162,534 A 12/2000 Hamerski
6,406,781 B1 6/2002 Hamerski
6,499,707 B2 12/2002 Hamerski et al.
6,527,900 B1 3/2003 Kreckel et al.
6,694,543 B2 2/2004 Moore
6,835,452 B1 12/2004 Hamerski
6,845,955 B1 * 1/2005 Hsu ..... A47K 3/38 211/123
7,207,543 B2 4/2007 Ortwein
7,575,208 B2 8/2009 Lan
7,762,508 B2 7/2010 Xu
8,043,459 B2 10/2011 Xie et al.
8,043,460 B2 10/2011 Xie et al.
8,069,508 B2 12/2011 O'Connell
8,080,198 B2 12/2011 Verhaert et al.
8,231,755 B2 7/2012 Xie et al.
8,251,163 B2 8/2012 Xie et al.
8,377,542 B2 2/2013 Xie et al.
8,806,670 B2 * 8/2014 O'Connell ..... A47K 3/38 211/105.1
2002/0009568 A1 1/2002 Bries et al.
2002/0017359 A1 2/2002 Luhmann
2002/0020790 A1 2/2002 Hamerski et al.
2002/0114911 A1 8/2002 Franck et al.
2002/0132115 A1 9/2002 Hamerski et al.
2002/0188057 A1 12/2002 Chen
2003/0049439 A1 3/2003 Johansson et al.
2003/0134112 A1 7/2003 Kreckel et al.
2003/0168165 A1 9/2003 Hatfield
2003/0211317 A1 11/2003 Sheridan et al.
2003/0232190 A1 12/2003 O'Leary et al.
2004/0005454 A1 1/2004 Full et al.
2004/0046094 A1 3/2004 Lan
2004/0086710 A1 5/2004 Pitzen et al.
2004/0092663 A1 5/2004 Krawinkel
2004/0178310 A1 9/2004 Marion
2004/0188580 A1 9/2004 Ryu et al.
2005/0013996 A1 1/2005 Hatfield
2005/0268394 A1 12/2005 Monk et al.
2006/0068144 A1 3/2006 Mizuno et al.
2006/0142447 A1 6/2006 Hatfield
2006/0185072 A1 * 8/2006 Dyckow ..... A47K 3/38 4/609
2007/0003758 A1 1/2007 Jin
2007/0006377 A1 1/2007 Moore
2007/0102601 A1 5/2007 Thompson
2007/0104395 A1 5/2007 Kinigakis et al.
2007/0169260 A1 * 7/2007 Huang ..... A47K 3/38 4/558
2007/0254127 A1 11/2007 Lin et al.
2007/0257165 A1 11/2007 Newbould et al.
2007/0289786 A1 12/2007 Cutkosky et al.
2008/0022451 A1 1/2008 Urlich et al.
2008/0026213 A1 1/2008 Lan
2008/0135159 A1 6/2008 Bries et al.
2008/0257486 A1 10/2008 Xie et al.
2008/0262188 A1 10/2008 Xie et al.
2008/0280086 A1 11/2008 Sheridan et al.
2009/0051257 A1 2/2009 Picken et al.
2009/0090461 A1 4/2009 Xie et al.
2009/0145539 A1 6/2009 Kreckel et al.
2009/0229732 A1 9/2009 Determan et al.
2009/0254057 A1 10/2009 Ceusters et al.
2009/0280330 A1 11/2009 Xie et al.
2010/0021647 A1 1/2010 Sitti et al.
2010/0038502 A1 2/2010 Lan
2010/0221496 A1 9/2010 de Jong
2010/0252177 A1 10/2010 Sargent et al.
2010/0252709 A1 10/2010 Weng
2010/0262103 A1 10/2010 Turner et al.
2011/0020640 A1 1/2011 Sherman et al.
2011/0031198 A1 * 2/2011 Trettin ..... A47H 1/022 211/123
2011/0113547 A1 5/2011 O'Connell
2012/0028040 A1 2/2012 Kai et al.
2012/0032043 A1 2/2012 McGreevy et al.
2012/0036628 A1 2/2012 O'Connell
2012/0070659 A1 3/2012 Nakagawa et al.
2012/0145847 A1 6/2012 Wang
2012/0153102 A1 6/2012 Thompson
2012/0202035 A1 8/2012 Xie et al.
2012/0216949 A1 8/2012 Carey Stachowski et al.
2012/0306188 A1 12/2012 Chen
2012/0308763 A1 12/2012 Chen
2013/0181102 A1 7/2013 Tooley et al.
2013/0198949 A1 * 8/2013 Hai ..... A47K 3/38 4/610
2014/0034246 A1 2/2014 Kenney et al.
2014/0069578 A1 3/2014 Xie et al.

FOREIGN PATENT DOCUMENTS

EP 1051450 B1 5/2004
EP 1440989 A2 7/2004
EP 1440989 A3 1/2005
EP 1141158 B1 3/2006
EP 1710287 A2 10/2006
EP 1710287 A3 2/2007
JP 2001104118 A 4/2001
JP 2002501107 A 1/2002
TW M380071 U1 5/2010
WO 2008028120 A1 3/2008
WO 2012078249 A2 6/2012
WO 2012078249 A3 6/2012
WO 2012120268 A1 9/2012

* cited by examiner

SHOWER ROD MOUNTING ASSEMBLY

TECHNICAL FIELD

Various embodiments relate to shower rod mounting assemblies.

BACKGROUND

Conventional shower rod assemblies for supporting a shower curtain are mounted to a pair of support surfaces with fasteners. Mechanical fasteners damage the support surfaces during installation. Further damage may be caused during removal, particularly if an excessive load is inadvertently applied to the shower rod assembly. The mechanical fasteners provide limited flexibility. If inadvertently installed incorrectly, movement of the shower rod assembly to another location results in exposed holes formed in the support surface, which may include tiles that are difficult and costly to repair.

Adhesive mount shower rod assemblies use traditional pressure sensitive adhesives which typically contain both a foam layer and an adhesive layer in order to conform to the surface of interest. These assemblies use substantially rigid flanges or mounting plates such as zinc die-cast, stamped steel or injection molded plastic. Once installed these systems are difficult to remove. Additionally, the adhesive leaves behind a significant amount of adhesive residue and foam, requiring harsh chemicals to clean the surface.

Length adjustable or telescopic shower rods are known in the industry. Some are mounted into mounting assemblies with fasteners described above. Some are provided with elastomeric fittings at each end for contacting the support surfaces. The adjustable shower rods are expanded to engage the support surfaces such that the shower rod is in compression to employ friction for maintaining the installation of the shower rod. The compression of the shower rod may be provided by a threaded engagement between concentric rods, a spring or the like. Such adjustable shower rods, may become inadvertently uninstalled due to exposure to steam that may reduce friction at the mounting surface, or fatigue of the spring over time.

SUMMARY

According to at least one embodiment, a shower rod mounting assembly is provided with a flexible substrate having a first side and a spaced apart second side. A reversible dry adhesive layer at least partially covers the first side of the substrate to attach the flexible substrate to a surface and leave the underlying surface unmarked after removal. The reversible adhesive retains an adhesion property for a plurality of adhesion cycles. A receptacle is mounted to the second side and is adapted to receive an end of a shower rod.

According to at least another embodiment, a shower rod mounting assembly is provided with a substrate having a first side and a spaced apart second side. An adhesive layer at least partially covers the first side of the substrate to attach the flexible substrate to a surface. A boss extends from the substrate with a track formed therein with an opening to receive an end of a shower rod. A biasing member extends from the substrate adjacent to the opening to retain the end of the shower rod after installation.

According to at least another embodiment, a method for installing a shower rod assembly provides a pair of flexible substrates, each with a receptacle. The pair of flexible substrates is adhered to opposing surfaces with a reversible dry adhesive that retains an adhesion property for a plurality of adhesion cycles. A shower rod is installed into the pair of receptacles.

According to at least another embodiment, a shower rod assembly is provided with a length adjustable rod and a pair of shower rod mounting assemblies. Each shower rod mounting assembly is provided with a flexible substrate having a first side and a spaced apart second side. A reversible dry adhesive layer at least partially covers the first side of the substrate to attach the flexible substrate to a surface and leave the underlying surface unmarked after removal. The reversible adhesive retains an adhesion property for a plurality of adhesion cycles. A receptacle is mounted to the second side and is adapted to receive an end of a shower rod.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Surfaces found in bath enclosures are typically flat, nonporous and smooth but imperfect on a microscopic level. These characteristics are common for various materials and the associated methods of manufacture, such as plate glass, fiberglass, plastic or tile. With that understanding, a flexible adhesive may be used to attach a mounting plate to effectively conform to and adhere to the mounting surface. Such flexibility enables maximum adhesion by eliminating random air pockets which would be present if a more rigid adhesive material were to be used. A majority of the mounting plate system can be flexible so that the contact surface can be subjected to a peel away force in an occurrence of relocating the mounting plate location. In addition, to prevent self-delamination in actual use, the applied forces can be transferred to the adhesive layer so that the forces are in shear.

Dry adhesives, which are reversible and reusable, are part of many recent advancements being made in temporary adhesive technologies. These adhesives bond well to smooth non-porous surfaces and are very strong in shear yet have weak bonding in peel. These adhesives represent a synthetic bio-mimicry approach to replicate adhesion performance characteristics of Gecko setae. These dry adhesives can be embodied by an adhesive pad that can be peeled away from the mounting surface without any glue residue remaining on the surface. Additionally, the adhesive pad can then be repeatedly repositioned without a measurable loss in shear performance. Adapting products to these technologies presents technical challenges in design and engineering that ensures a proper aesthetic while keeping application of loads in a shear direction. Therefore, a suitable embodiment minimizes total forces in the peel direction.

Figure 1:
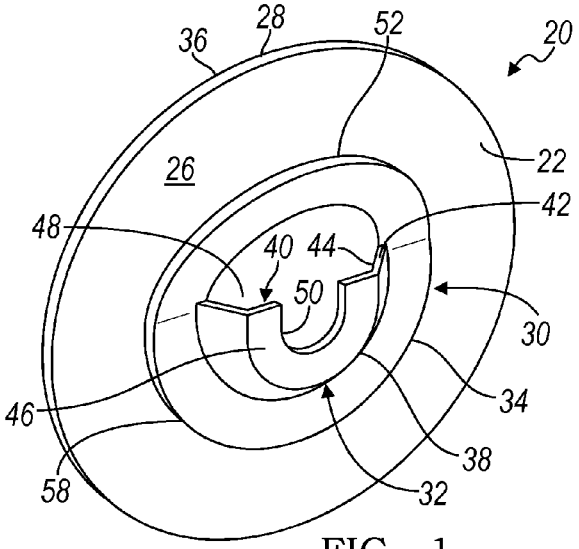
FIG. 1 is a front perspective view of a shower rod mounting assembly according to an embodiment.
Figure 2:
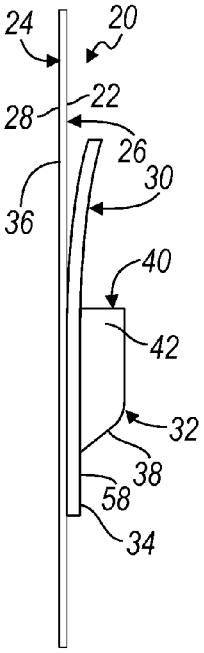
FIG. 2 is a side elevation view of the shower rod mounting assembly of FIG. 1.

With reference to FIGS. 1 and 2, a shower rod mounting assembly 20 is illustrated. The shower rod mounting assembly 20 includes a flexible substrate or pad 22 having a wall side 24 and a spaced apart rod side 26. A reversible dry adhesive layer 28 covers the wall side 24 of the pad 22 to attach the flexible pad 22 to a surface and leave the underlying surface unmarked after removal. The reversible adhesive retains an adhesion property for a plurality of adhesion cycles.

The mounting assembly 20 also includes a mounting plate 30 with a receptacle 32 to receive an end of a shower rod. The flexible adhesive layer 28 makes contact with the mounting surface. The thin, flexible pad 22 bonds the adhesive layer 28 to a base 34 of the mounting plate 30. A release paper 36 is provided upon the adhesive layer 28 to protect the adhesive during storage and transportation; and for removal during installation to expose the adhesive layer 28. The mounting plate 30 is formed from a suitable material for providing the receptacle 32 and supporting the shower rod, such as a structural plastic or a metallic material. Such materials may not be sufficiently deformable to peel the adhesive layer 28 so the base 34 of the mounting plate 30 and the adhesive layer 28 are separated by the flexible pad 22. Any suitable adhesive may be employed for securing the base 34 of the mounting plate 30 to the pad 22. According to one embodiment, the mounting plate 30 may be formed from a clear or translucent material, such as (PC) Polycarbonate. An ultraviolet (UV) curable adhesive may be employed to speed assembly in manufacturing due to a reduced cure time of such adhesives. PC has a high level of transparency that allows UV curable adhesives to cure directly through the mounting plate 30.

Any suitable adhesive may be selected to allow maximum conformance to the substrate mounting surface on the wall side 24 that has sufficient flexibility to peel the pad 22 for removal of the mounting plate from the surface with minimal effort and without residue. The pad 22 can therefore be made from any number of materials which can be bonded to both the adhesive layer 28 and the mounting plate 30. The pad 22 can therefore be formed from a thin sheet of a thermoplastic polymer, such as polycarbonate (PC), polypropylene (PP), polyethylene terephthalate (PET), biaxially-oriented polyethylene terephthalate (BoPet), or the like. Alternatively, the pad 22 may be formed from vinyl, cloth or the like.

The adhesive layer 28 can be made from a reversible adhesive material. The reversible adhesive material may be a block copolymer. The reversible adhesive material may have material properties that provide for a shear strength that is higher than a peel strength when in use. For example, the dynamic shear strength may be one to five pounds per inch width, and the peel strength may be 0.01 to 0.05 pounds per inch width (or may be 20 to 500 times greater, etc.). This allows the mounting plate 30 to remain affixed to an underlying surface such as a vertical wall, while making the mounting plate 30 easy to remove by the user.

The adhesive layer 28 may be a thermoplastic elastomer, such as a styrene thermoplastic elastomer. For example, the adhesive layer 28 may include a thermoplastic elastomer (TPE), thermoplastic rubber (TPR), a styrene-butadiene styrene (SBS) block copolymer, or the like. According to one embodiment, the adhesive layer 28 includes the following compositions or composition ranges by weight: 100 parts styrene-ethylene-butadiene-styrene (SEBS) block copolymer, 100-300 parts hydrogenated naphthenic oil, 100-300 parts white oil, 0-10 parts petroleum adhesion promoter resin, 1-5 parts polypropylene resin, 2-10 parts assistant agent. In one embodiment, the adhesive layer may be a G or D series product from Kraton Company, or a YH series product from Balin Huaxing Petrochemical Ltd. in Yueyang China. In another embodiment, the adhesive layer may be from Ren-River Rubber Products as described in U.S. patent application Ser. No. 13/390,689 by Wang filed on Feb. 15, 2012 and incorporated by reference in its entirety herein. The reversible adhesive may also be an adhesive material as described in International Application No. PCT/US2011/057309 by Crosby et al. filed Oct. 21, 2011 and incorporated by reference in its entirety herein. Other suitable reversible adhesives are also contemplated for use with the mounting plate 30.

Figure 3:
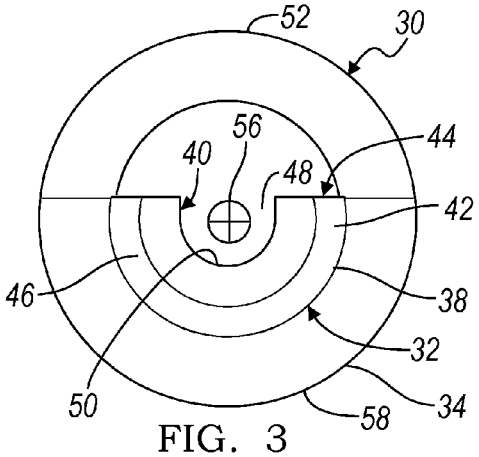
FIG. 3 is front elevation view of a mounting plate of the shower rod mounting assembly of FIG. 1, according to an embodiment.

Referring to FIGS. 1 to 3, the receptacle 32 includes a boss 38 extending from the base 34 with a track 40 formed therein to receive the end of the shower rod. The boss 38 may be formed with a sidewall 42 extending from a portion of the base 34 thereby providing a primary slot 44 of the track 40. A sector ring 46 is mounted to the sidewall 42 and is spaced apart from the base 34 so that a cavity 48 is provided within the pad 22, the sidewall 42 and the sector ring 46. A secondary slot 50 is provided in the sector ring 46 to the cavity 48. The secondary slot 50 has a width less than a width of the primary slot 44 to provide a T-slot or dual width track 40.

The base 34 of the mounting plate 30 is formed as an annular ring according to an embodiment. A portion of the annular ring is angled away from the pad 22 to provide a beam 52 adjacent to the primary slot 44. The extension of the beam 52 away from the pad 22 reduces contact area between the base 34 and the pad 22 adjacent to the track 40. The mounting plate 30 may be formed from a material with a large range of elastic deformation so that the beam 52 provides a biasing member or spring for retention of the end of the shower rod, such as serving as a containment strap.

The track 40 is formed to a blind depth to provide a support surface 54 (FIGS. 7 and 8) for the shower rod. The mounting plate 30 may be installed in the orientation depicted such that the secondary slot 50 is oriented upright to utilize gravity for retention of the shower rod in the secondary slot 50. The secondary slot 50 and the support surface 54 collectively provide a centroid 56 (FIG. 3) in supporting the shower rod. A majority of a contact area 58 between the base 34 and the pad 22 is oriented below the centroid 56 so that a reaction force upon the reversible dry adhesive layer 28 caused by support of the shower rod is in shear. This approach ensures maximum flexibility and conformance of the assembly while distributing forces below the centroid 56 and effectively in shear or a downward direction.

Figure 4:
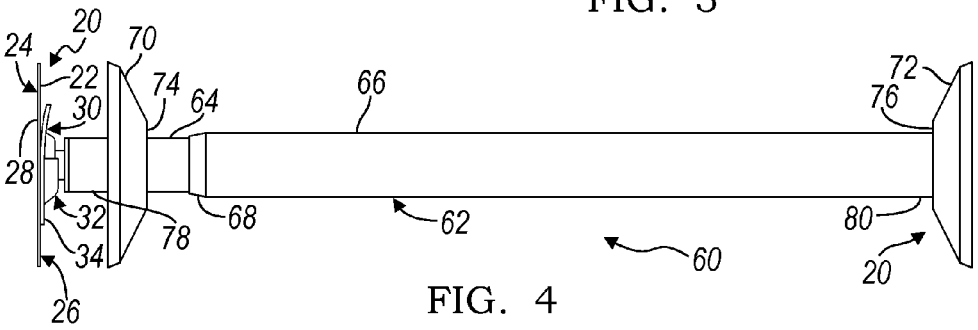
FIG. 4 is a side elevation view of a shower rod assembly according to an embodiment, illustrated installed into a pair of shower rod mounting assemblies according to FIG. 1.

Referring now to FIG. 4, a shower rod assembly 60 is illustrated with a length adjustable, or telescopic, shower rod 62 mounted to a pair of shower rod mounting assemblies 20. The shower rod 62 includes a minor tube 64 that extends within a major tube 66. An interface bushing 68 is provided at a distal end of the major tube 66 to receive minor tube 64; transition varying diameters of the tubes 64, 66; and reduce friction and the engagement. A pair of ornamental covers 70, 72 are provided, each with an aperture 74, 76 formed therethrough sized to receive the corresponding tube 64, 66. Each of the covers 70, 72 is sized to cover one of the shower rod mounting assemblies 20 and one of the shower rod ends, which are each provided at a proximal end 78, 80 of one of the tubes 64, 66.

Figure 5:
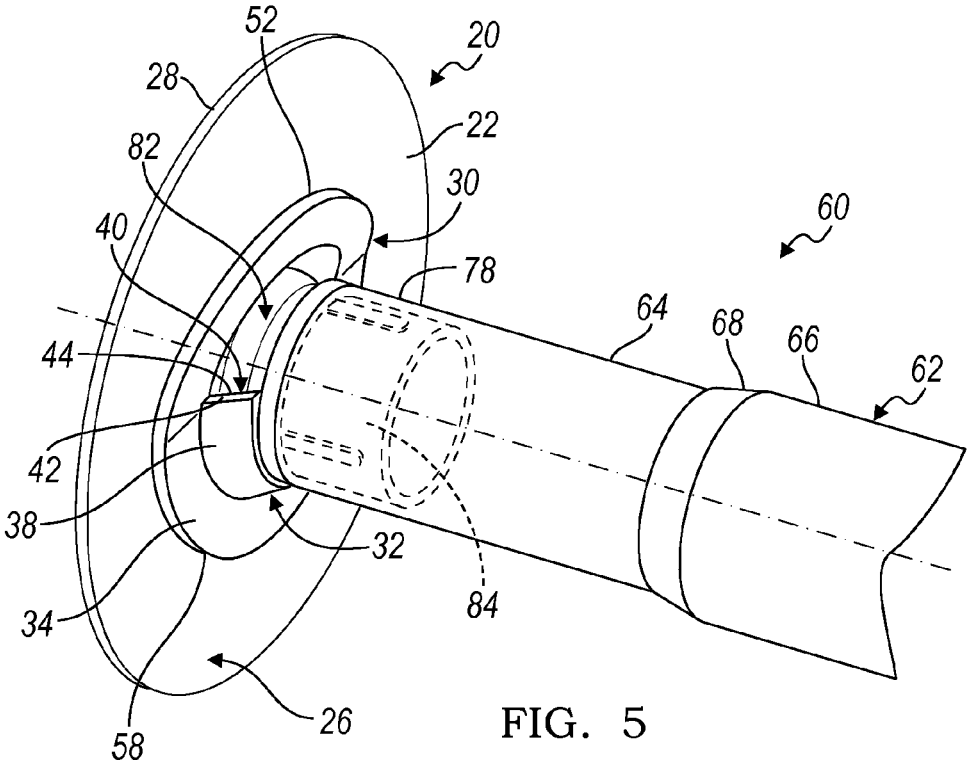
FIG. 5 is an enlarged perspective view of an end of the shower rod assembly of FIG. 4.
Figure 6:
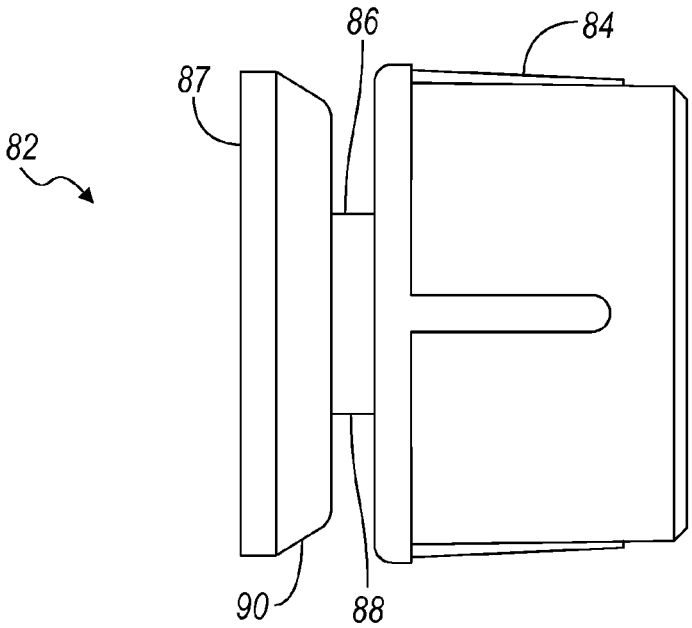
FIG. 6 is an enlarged side view of a fitting of the shower rod assembly of FIG. 4, according to an embodiment.

FIG. 5 illustrates an end fitting 82 attached to the proximal end 78 of the minor tube 64. The end fitting 82 is also illustrated in FIG. 6; and can also be employed at the proximal end 80 of the major tube 66. The end fitting 82 has a body 84 that can be held within the minor tube 64 by adhesive, with mechanical lock tabs, by internal press fit or by an external compression fit mechanism. The end fitting 82 includes a circumferential groove 86 which is designed to limit movement of the shower rod 62 parallel to a tube axis. A head 87 extends from a shank 88 with a reduced diameter. A chamfer 90 helps to align the fitting 82 and consequently, the shower rod 62 into the primary slot 44 in the mounting plate 30.

Figure 7:
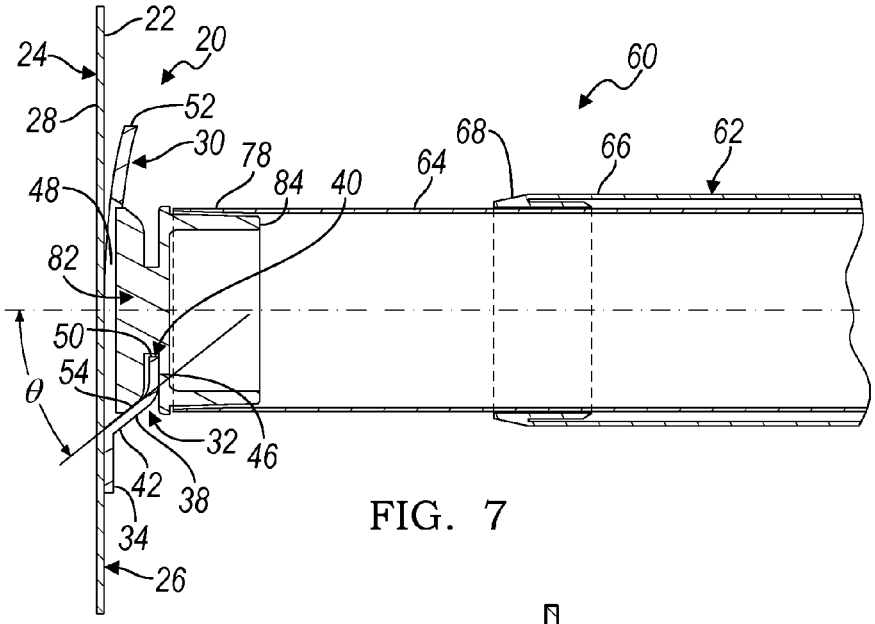
FIG. 7 is an enlarged section view of an end of the shower rod assembly of FIG. 4.
Figure 8:
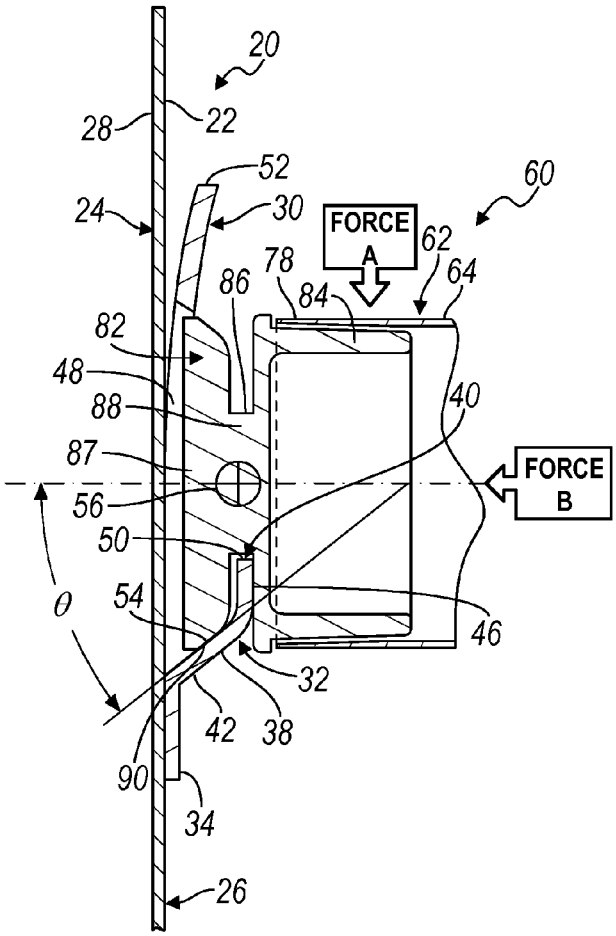
FIG. 8 is a further enlarged section view of the end of the shower rod assembly of FIG. 4.

FIGS. 7 and 8 illustrate the cooperation of the shower rod 62 and one of the shower rod mounting assemblies 20 in greater detail. As stated previously, temporary adhesives are effective when forces are applied primarily in the shear direction. Once the shower rod 62 is fully engaged into the mounting plate 30 a first point of contact is provided at the chamfer 90 and the support surface 54. This contact is at an angle θ within a range of twenty to ninety degrees relative to a horizontal axis or an axis of the shower rod 62. For the depicted embodiment, the angle θ is thirty degrees. A weight of the shower rod 62 and an associated curtain assembly is represented by a Force A, which has a tendency to draw the shower rod 62 toward the mounting surface noted as Force B. With further examination of FIG. 8 it can be seen that the point of contact 90, 54 is significantly below the centroid 56 which places the loading of the entire assembly 20 in shear relative to the pad 22.

During assembly, the beam 52 is slightly compressed to permit the head 87 to enter the primary slot 44. Once fully installed the beam 52 returns over the end fitting 82 and prevents the end fitting from movement perpendicular to the center axis of the shower rod 62. Therefore, the beam 52 retains the shower rod 62 assembled to the shower rod mounting assembly 20.

A substantially flexible shower rod mounting assembly 20 exerts applied forces in shear while being flexible enough to peel the pad 22 away when movement is required. In the proposed design ninety percent of the contact surface area 58 between the base 34 and the pad 22 is located below the centroid 56 or center axis of the shower rod 62. Alternatively, more than fifty percent of this contact surface area 58 should be oriented below the centroid 56 in order to maintain the loading on the adhesive layer 28 in shear. In order for the shower rod mounting system 20 to be flexible to facilitate manual peeling of the pad 22 and the adhesive layer, a surface area of the pad 22 is greater than the contact surface area 58. For example, in the illustrated embodiment, the contact surface area 58 is ten percent of the total area of the pad 22. Alternatively, the contact surface area 58 is less than half of the total area of the pad 22.

The end fittings 82 and the mounting plate 30 contain geometry to transfer loading to the pad 22 and the wall surface by the tapered or angled surfaces of the chamfer 90 and the support surface 54. Of course, other geometries can achieve this function, such as an orb mating with an angled surface as one example.

The proposed shower rod mounting assembly 20 provides a solution for installation of a shower curtain rod assembly 60 within a bath or shower enclosure area without drilling holes in the support surface. This solution eliminates drilling into non-porous surfaces which may result in costly repairs if performed or positioned incorrectly.

Figure 10:
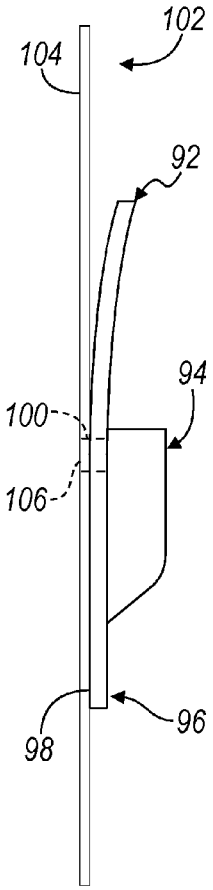
FIG. 10 is a side elevation view of a shower rod mounting assembly, according to another embodiment, including the mounting plate of FIG. 9.
Figure 9:
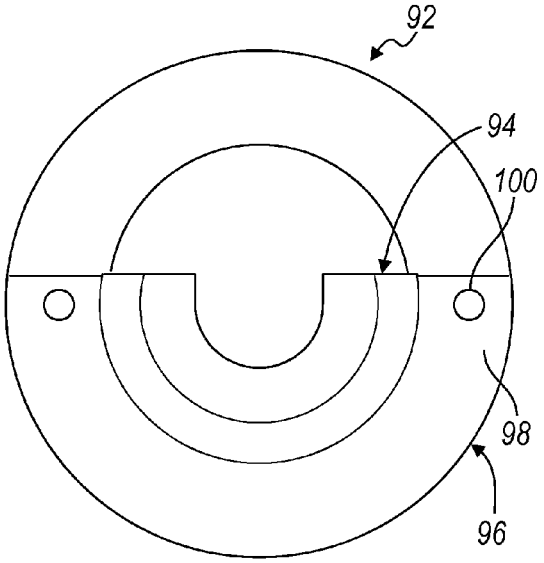
FIG. 9 is a rear elevation view of a mounting plate, according to another embodiment.

FIG. 9 illustrates a mounting plate 92 according to another embodiment. Similar to the prior embodiment, the mounting plate 92 includes a receptacle 94 upon a base 96, which provides a relatively flat base contact area 98. A pair of projections 100 extends from the base contact area 98 for locating of the mounting plate 92. FIG. 10 illustrates a shower rod mounting assembly 102 according to another embodiment. A flexible pad 104 is provided, which is similar to the pad 22 of the prior embodiment. The pad 104 includes a pair of apertures 106 that are sized to receive the projections 100 of the mounting plate 92 for locating the mounting plate 92 relative to the pad 104. Other suitable fixtures may be used for relative positioning. While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A shower rod mounting assembly comprising:

a flexible substrate having a first side and a spaced apart second side;

a reversible dry adhesive layer at least partially covering the first side of the substrate to attach the flexible substrate to an underlying surface and leave the underlying surface unmarked after removal, the reversible adhesive retaining an adhesion property for a plurality of adhesion cycles; and a receptacle mounted to the second side adapted to receive an end of a shower rod;

wherein the receptacle is formed from a separate material than the substrate;

wherein the receptacle comprises:

a base mounted to the substrate, and a boss extending from the base with a track formed therein to receive the end of the shower rod;

wherein the base comprises an annular ring;

wherein the boss comprises:

a sidewall extending from a portion of the annular ring providing a primary slot, and a sector ring mounted to the sidewall and spaced apart from the annular ring so that a cavity is provided within the substrate, the sidewall and the sector ring, wherein a secondary slot is provided in the sector ring, the secondary slot having a width less than a width of the primary slot.

2. The shower rod mounting assembly of claim 1 further comprising a release paper provided upon and covering a contact surface of the reversible dry adhesive layer for removal during installation.

3. The shower rod mounting assembly of claim 1 wherein the receptacle is formed from material that is more rigid than the substrate.

4. The shower rod mounting assembly of claim 1 wherein the track is further defined as a slot with a primary width and a secondary width that is smaller than the primary width.

5. The shower rod mounting assembly of claim 1 wherein the track is further defined as a T-slot.

6. The shower rod mounting assembly of claim 1 wherein the annular ring has a reduced contact area upon the substrate above the secondary slot so that a reaction force upon the reversible dry adhesion layer caused by support of the shower rod is in shear.

7. The shower rod mounting assembly of claim 6 wherein a portion of the annular ring adjacent the primary slot is angled away from the substrate to reduce the contact area with the substrate and to provide a biasing member for retention of the end of the shower rod.

8. A shower rod assembly comprising:

a pair of shower rod mounting assemblies, each according to claim 7; and a length adjustable shower rod having a pair of ends, the rod having a pair of circumferential grooves formed therein each offset from one of the pair of shower rod ends to provide a reduced diameter that is sized to be received within the secondary slot of one of the shower rod mounting assemblies, wherein each biasing member provides interference to installation of the shower rod end into the shower rod mounting assembly in an unloaded condition requiring an external force upon the biasing member to provide clearance for installation of the shower rod end.

9. The shower rod mounting assembly of claim 1 wherein the track has a blind depth to provide a support surface for the end of the shower rod.

10. The shower rod mounting assembly of claim 9 wherein the support surface provides a centroid for support of the end of the shower rod; and wherein a majority of a contact area between the annular ring and the substrate is oriented below the centroid when the secondary slot is oriented upright so that a reaction force upon the reversible dry adhesion layer caused by support of the shower rod is in shear.

11. The shower rod mounting assembly of claim 10 wherein at least ninety percent of the contact area between the annular ring and the substrate is oriented below the centroid when the secondary slot is oriented upright.

12. A shower rod assembly comprising:

a length adjustable rod; and a pair of shower rod mounting assemblies, each according to claim 1.

13. The shower rod assembly of claim 12 further comprising a pair of ornamental covers each having an aperture formed therethrough sized to receive the length adjustable rod, and each being sized to cover one of the shower rod mounting assemblies and one of the shower rod ends.

14. A shower rod mounting assembly comprising:

a substrate having a first side and a spaced apart second side;

an adhesive layer at least partially covering the first side of the substrate to attach the substrate to a surface;

a boss extending from the substrate with a track formed therein with an opening to receive an end of a shower rod; and a flexible biasing member extending from the substrate adjacent to the opening to retain the end of the shower rod after installation;

an annular ring extending from the substrate;

wherein the substrate is flexible;

wherein the adhesive layer comprises a reversible dry adhesive layer to leave the underlying surface unmarked after removal, the reversible adhesive retaining an adhesion property for a plurality of adhesion cycles; and wherein the boss comprises:

a sidewall extending from a portion of the annular ring providing a primary slot, and a sector ring mounted to the sidewall and spaced apart from the annular ring so that a cavity is provided within the substrate, the sidewall and the sector ring, wherein a secondary slot is provided in the sector ring, the secondary slot having a width less than a width of the primary slot.

15. The shower rod mounting assembly of claim 14 wherein the annular ring has a reduced contact area upon the substrate above the secondary slot so that a reaction force upon the reversible dry adhesion layer caused by support of the shower rod is in shear.

16. The shower rod mounting assembly of claim 15 wherein a portion of the annular ring adjacent the primary slot is angled away from the substrate to reduce the contact area with the substrate and to provide a biasing member for retention of the end of the shower rod.

17. A shower rod mounting assembly comprising:

a flexible substrate having a first side and a spaced apart second side;

a reversible dry adhesive layer at least partially covering the first side of the substrate to attach the flexible substrate to an underlying surface and leave the underlying surface unmarked after removal, the reversible adhesive retaining an adhesion property for a plurality of adhesion cycles; and a receptacle mounted to the second side adapted to receive an end of a shower rod, wherein the receptacle comprises:

an annular ring mounted to the substrate, a sidewall extending from a portion of the annular ring providing a primary slot to receive the end of the shower rod therein, and a sector ring mounted to the sidewall and spaced apart from the annular ring so that a cavity is provided within the substrate, the sidewall and the sector ring, wherein a secondary slot is provided in the sector ring, the secondary slot having a width less than a width of the primary slot to receive the end of the shower rod therethrough.

18. The shower rod mounting assembly of claim 17 wherein the annular ring has a reduced contact area upon the substrate above the secondary slot so that a reaction force upon the reversible dry adhesion layer caused by support of the shower rod is in shear.

19. The shower rod mounting assembly of claim 18 wherein a portion of the annular ring adjacent the primary slot is angled away from the substrate to reduce the contact area with the substrate and to provide a flexible biasing member for retention of the end of the shower rod.

* * * * *